United States Patent [19]

Miller et al.

[11] Patent Number: 4,858,665

[45] Date of Patent: Aug. 22, 1989

[54] HOCKEY STICK BLADE BENDER

[76] Inventors: Thomas R. Miller, 16001 Kangaroo St. NW.; John W. Green, 16011 Kangaroo St. NW.; Mark Motz, 8261 159th La., all of Ramsey, Minn. 55303

[21] Appl. No.: 278,711

[22] Filed: Dec. 2, 1988

[51] Int. Cl.[4] ..... B27M 1/00; B27H 1/00

[52] U.S. Cl. ..... 144/380; 72/458; 72/463; 72/479; 144/2 R; 144/270; 144/381

[58] Field of Search ..... 72/458, 463, 477, 479; 144/2 R, 269, 270, 380, 381

[56] References Cited

U.S. PATENT DOCUMENTS

| | | | |
|---|---|---|---|
| 3,965,720 | 6/1976 | Goodwin et al. | 72/479 |
| 4,644,778 | 2/1987 | Newton, II | 72/458 |
| 4,741,371 | 5/1988 | Lord | 144/270 |

*Primary Examiner*—W. Donald Bray
*Attorney, Agent, or Firm*—Hugh D. Jaeger

[57] ABSTRACT

A hockey stick bender for bending the blade of a hockey stick. The hockey stick bender includes a paddle member with a handle, and two opposing, curved forming members with a slot therebetween. The blade of the hockey stick is placed into the slot and manipulated between the two curved forming members to form a hockey stick blade.

4 Claims, 3 Drawing Sheets

HOCKEY STICK BLADE BENDER

BACKGROUND OF THE INVENTION

1. Field of the Invention

The present invention pertains to a hand-held bender or forming structure, and more particularly, pertains to a hand-held bender for bending the blade of a hockey stick.

2. Description of the Prior Art

A hockey stick blade in the past has been bent by heating the hockey stick blade, such as in an oven, and then placing the blade inbetween a door and a jamb, and bending the blade. This has not always been satisfactory, in that the blade has tended to be crimped, rather than having a uniform, rolling curve.

Sometimes, to the person who is not skilled at the art of bending hockey stick blades, it was very easy to crimp a blade and destroy an expensive hockey stick. At other times, the wood laminations would tend to separate because of the uneven forces which were applied.

The present invention overcomes the disadvantages of the prior art by providing a bender for a hockey stick blade.

SUMMARY OF THE INVENTION

The general purpose of the present invention is to provide a bender, which can also be referred to as forming device, for the blade of a hockey stick. The bender is hand-held and easily utilized, such as by young persons, as well as adults.

According to one embodiment of the present invention, there is provided a bender for a hockey stick blade, including a paddle like member with a handle, a slot and opposing curved forming members facing outwardly from the upper and lower sides of the slot. The method for forming the curvature in the hockey stick blade is to heat the hockey stick blade, such as in an oven, insert the blade in through the slot, and then manipulate the blade with respect to the two curved forming members to obtain the desired curvature for the blade.

Significant aspects and features of the present invention include a bender for a hockey stick blade which is utilizable by young persons, as well as adults, and can be manipulated by an individual to place any curvature or remove any curvature from a hockey stick blade.

Having thus described the embodiments of the present invention, it is a principal object hereof to provide a bender for a hockey stick blade.

Objects of the present invention include a bender for a hockey stick blade which places a predetermined, desired degree of curvature about a blade of a hockey stock or removes a degree of curvature from a hockey stick blade.

BRIEF DESCRIPTION OF THE DRAWINGS

Other objects of the present invention and many of the attendant advantages of the present invention will be readily appreciated as the same becomes better understood by reference to the following detailed description when considered in connection with the accompanying drawings, in which like reference numerals designate like parts throughout the figures thereof and wherein.

DESCRIPTION OF THE PREFERRED EMBODIMENTS

Figure 1:
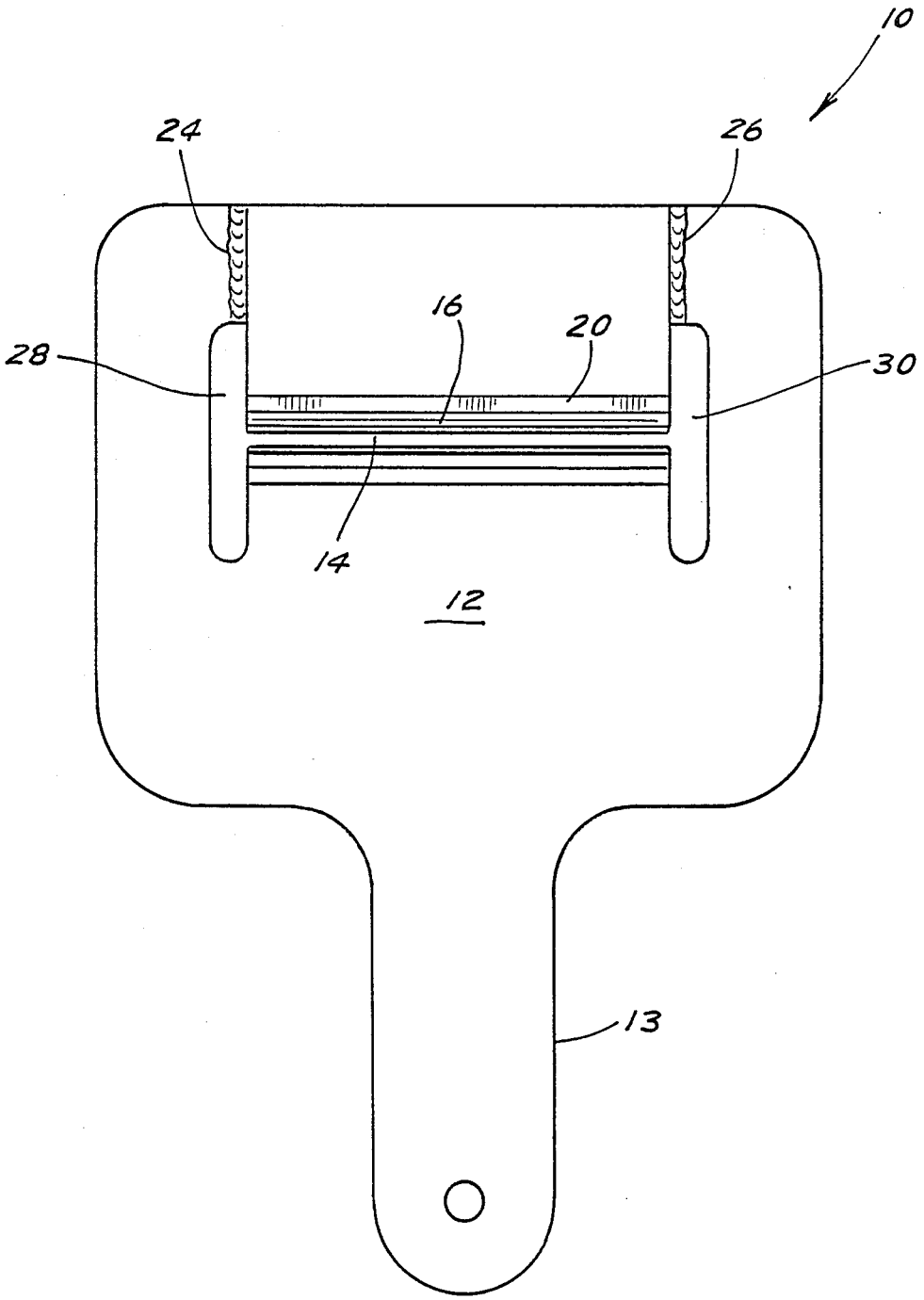
FIG. 1 illustrates a front view of the present invention, a bender for a hockey stick blade.
Figure 2:
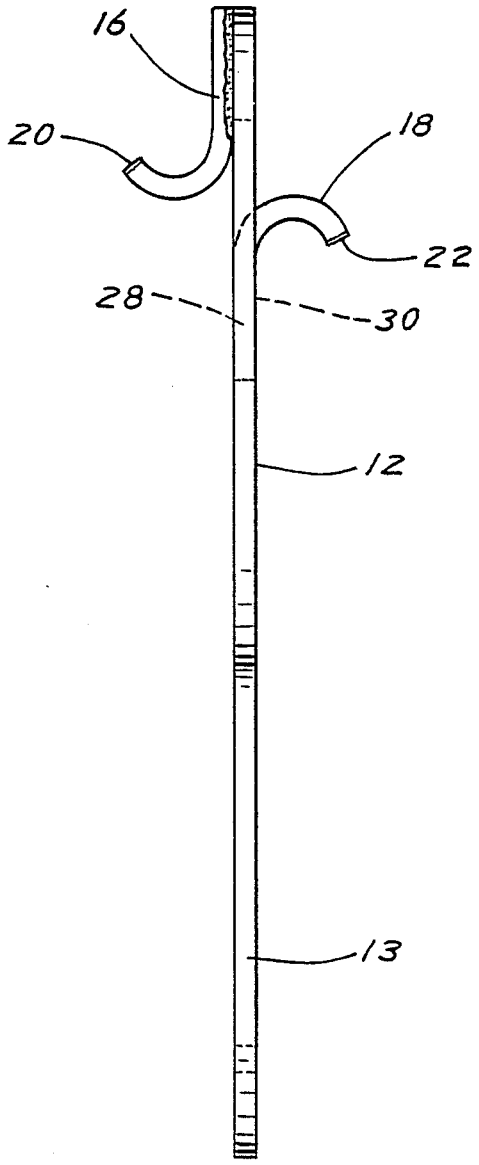
FIG. 2 illustrates a side view.

FIG. 1 illustrates a front view of a bender 10 of the present invention for a hockey stick blade. The bender 10 includes a paddle member 12 and a handle 13 integral thereto. The shape of the bender is analogized to that of a ping-pong paddle. There is a horizontal slot 14 and two diametrically opposing, mirror image, curved forming members 16 and 18 with ends 20 and 22 as also illustrated in FIG. 2 extended outwardly. The curved forming member 16 in this illustration is a separate member welded at welds 24 and 26 to the paddle member 12 by way of example and for purposes of illustration only and not to be construed as limiting of the present invention. Optional vertical slots 28 and 30 are provided for ease of movement of the blade of a hockey stick.

FIG. 2 illustrates a side view of the bender 10 where all numerals correspond to those elements previously described.

MODE OF OPERATION

Figure 3:
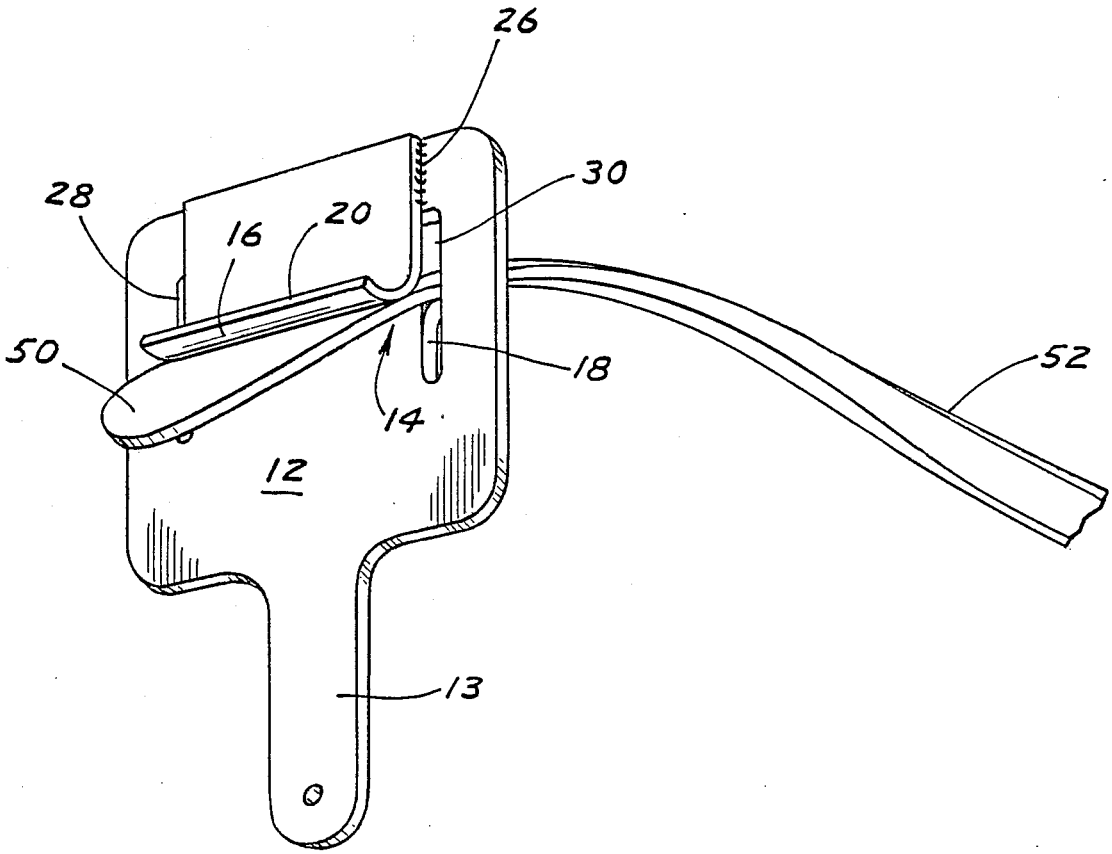
FIG. 3 illustrates a perspective view of the bender bending a hockey stick blade.

FIG. 3 illustrates a perspective view of a blade 50 of a hockey stick 52 inserted through the slot 14 and being formed about the curved forming members 16 and 18. The blade 50 of the hockey stick 52 can be heated in an oven, by way of example and for purposes of illustration only and not to be construed as limiting, prior to the bending and forming process. Depending upon the degree of curvature and the size and thickness of the blade, it is a matter of degree as to the amount of pressure exerted about the horizontal length of the blade 50 from the handle 52 to obtain the desired degree of curvature.

The bender 10 can be made from any suitable material, and in this case is made from 7 gauge plated steel. The length of the slot 14 is about 4 inches. The curved portions of the curved forming members 16 and 18 are about $1\frac{1}{4}$ inches. The length and width of the vertical slots 28 and 30 is about 2 inches by $\frac{1}{4}$ inch. The rectangular dimensions of the paddle member 12 are about 5 inches by 6 inches. The size of the handle 14 is $1\frac{1}{2}$ inches by 4 inches.

Various modifications can be made to the present invention without departing from the apparent scope hereof.

We claim:

1. Hockey stick blade bender comprising:

a. paddle member with an integral handle;

b. a horizontal slot in a midportion of said paddle member; and, c. two opposing curved forming members extending outwardly from said paddle member and diametrically opposed with respect to each other, whereby said hockey stick blade is positioned through said slot and manipulated between said curved forming members, thereby imparting a degree of curvature along the longitudinal axis of said hockey stick blade.

2. The hockey stick blade bender of claim 1 including vertical slots on either side of said horizontal slot and said curved forming members, thereby providing for ease of movement of said hockey stick blade in said bender.

3. In combination, a hockey stick blade bender and a hockey stick blade comprising:

a. hockey stick blade bender including a paddle member with a handle integral thereto, a horizontal slot in a midportion of said paddle member, and two diametrically opposed mirror image curved forming members extending outwardly from said horizontal slot; and, b. hockey stick blade positioned through said horizontal slot and against said curved forming members.

4. Method for forming a curve into a hockey stick blade comprising the steps of:

a. heating the blade of the hockey stick;

b. inserting the blade of the hockey stick into a horizontal slot of a hockey stick blade bender; and, c. working the blade between diametrically opposed curved forming members of said hockey stick blade bender for imparting a degree of curvature along the longitudinal length of the hockey stick blade.

* * * * *